US012264854B2

(12) United States Patent
Lin et al.

(10) Patent No.: US 12,264,854 B2
(45) Date of Patent: Apr. 1, 2025

(54) HEAT EXCHANGE DEVICE AND COOLING SYSTEM HAVING THE SAME

(71) Applicant: CHROMA ATE INC., Taoyuan (TW)

(72) Inventors: Jian-Hung Lin, Taoyuan (TW); Shao-En Chung, Taoyuan (TW)

(73) Assignee: CHROMA ATE INC., Taoyuan (TW)

( * ) Notice: Subject to any disclaimer, the term of this patent is extended or adjusted under 35 U.S.C. 154(b) by 278 days.

(21) Appl. No.: 17/976,906

(22) Filed: Oct. 31, 2022

(65) Prior Publication Data

US 2023/0204260 A1 Jun. 29, 2023

(30) Foreign Application Priority Data

Dec. 27, 2021 (TW) ..... 110148922

(51) Int. Cl.

| | |
|---|---|
| ***F25B 13/00*** | (2006.01) |
| ***F25B 19/00*** | (2006.01) |
| ***F25B 39/04*** | (2006.01) |
| ***F28C 3/08*** | (2006.01) |

(52) U.S. Cl.

CPC ..... *F25B 13/00* (2013.01); *F25B 39/04* (2013.01); *F28C 3/08* (2013.01); *F25B 19/005* (2013.01)

(58) Field of Classification Search

CPC ..... F25B 39/028; F25B 13/00; F25B 39/04; F25B 19/005; F25B 2339/021; F25B 39/02; F28C 3/08; H01L 23/4735

See application file for complete search history.

(56) References Cited

U.S. PATENT DOCUMENTS

2005/0183844 A1* 8/2005 Tilton ..... H01L 23/4735 165/80.4

2007/0034356 A1* 2/2007 Kenny ..... F04B 17/00 257/E23.098

FOREIGN PATENT DOCUMENTS

CN 109944649 A * 6/2019

OTHER PUBLICATIONS

Pdf is translation of foreign reference CN 109944649 A (Year: 2019).*

* cited by examiner

*Primary Examiner* — Len Tran
*Assistant Examiner* — Kamran Tavakoldavani
(74) *Attorney, Agent, or Firm* — WPAT, PC

(57) ABSTRACT

A heat exchange device and a cooling system are provided. The heat exchange device includes a low-pressure chamber and a high-pressure chamber disposed in the low-pressure chamber. The low-pressure chamber has a first wall for enabling heat exchange and an output portion in communication with the outside to output the low-pressure fluid. The high-pressure chamber has an input portion in communication with the outside to admit the high-pressure fluid and nozzles in communication with the low-pressure chamber. The fluid discharged from the nozzles undergoes a pressure drop and undergoes heat exchange through the first wall. Cooling capability is developed in the heat exchange device and works in the heat exchange device to thereby dispense with a pipeline which must be otherwise provided to link an expansion process and an evaporation process of the fluid and may otherwise cause cooling capability loss, so as to greatly enhance heat exchange capability and cooling efficiency.

13 Claims, 4 Drawing Sheets

HEAT EXCHANGE DEVICE AND COOLING SYSTEM HAVING THE SAME

BACKGROUND OF THE INVENTION

Field of the Invention

The present disclosure relates to heat exchange devices and, more particularly, to a heat exchange device for use in a cooling system.

Description of the Prior Art

The operation process of a cooling system includes a compression process, condensation process, expansion process and evaporation process. With pipeline interconnection, the four processes of a refrigeration cycle are integrated to form a closed circulation pipeline system for cooling a target, using an evaporator for use in the evaporation process.

After undergoing the expansion process, the fluid in the cooling system attains a low temperature required to cool the target upon delivery to the evaporator via a pipeline. However, the low-temperature fluid may lose excessive cooling capability in the course of the pipeline-based delivery exposed to ambient temperature; to prevent the cooling capability loss, the pipeline has to be provided or enclosed with a thermal insulating layer. The thermal insulating layer is neither cost-efficient nor effective in eliminating cooling capability loss.

Furthermore, owing to the need to match the actual effective cooling capability with the required space taken up by the overall cooling system, the cooling efficiency of the evaporator cooling area cannot be enhanced, and in consequence a limited heat exchange area fails to attain sufficiently high heat exchange capability required to cool a target.

SUMMARY OF THE INVENTION

It is an objective of the disclosure to preclude a loss of cooling capability and promote cooling efficiency.

Another objective of the disclosure is to augment heat exchange capability.

In order to achieve the above and other objectives, the disclosure provides a heat exchange device for receiving a high-pressure fluid and outputting a low-pressure fluid. The heat exchange device comprises a low-pressure chamber and a high-pressure chamber. The low-pressure chamber has a first wall for enabling heat exchange and having an output portion in communication with an outside of the heat exchange device to output the low-pressure fluid. The high-pressure chamber is disposed in the low-pressure chamber, has an input portion in communication with the outside of the heat exchange device to admit the high-pressure fluid, and has a plurality of nozzles in communication with the low-pressure chamber. A fluid discharged from the nozzles undergoes a pressure drop, enters the low-pressure chamber, and undergoes heat exchange through the first wall so as to be turned into the low-pressure fluid.

In an embodiment of the disclosure, the nozzles enable the high-pressure fluid to undergo a pressure drop and a temperature drop.

In an embodiment of the disclosure, the nozzles are disposed on a second wall of the high-pressure chamber, and a cross-sectional area of each said nozzle is less than a predetermined value to cause the high-pressure fluid being discharged from the nozzles to turn into a jet of low-temperature fluid.

In an embodiment of the disclosure, the second wall faces the first wall.

In an embodiment of the disclosure, an inner wall of the high-pressure chamber takes on a funnel shape, with the second wall defining a bottom of the funnel, and the input portion defining a top of the funnel.

In an embodiment of the disclosure, the nozzles are each a hole.

In an embodiment of the disclosure, the nozzles are each a slit.

In an embodiment of the disclosure, the nozzles enable the high-pressure fluid to turn into a jet of fluid hitting the first wall.

In an embodiment of the disclosure, the high-pressure chamber has at least a cooling wall free of the nozzles, and the at least a cooling wall enables heat exchange between the low-pressure fluid in the low-pressure chamber and the high-pressure fluid in the high-pressure chamber.

In an embodiment of the disclosure, a plurality of heat exchange portions are disposed on the at least a cooling wall and protruding toward the low-pressure chamber. The heat exchange portions are fins.

In order to achieve the above and other objectives, the disclosure further provides a cooling system, adapted to cool a target, comprising a compression device, a condensation device and the heat exchange device. The condensation device receives a fluid of a high pressure and a high temperature from the compression device, causes the temperature of the fluid to drop and outputs the high-pressure fluid of a high pressure and a normal temperature. The heat exchange device receives the high-pressure fluid outputted from the condensation device and outputs the low-pressure fluid to the compression device, wherein the high-pressure fluid undergoes a pressure drop and a temperature drop in the high-pressure chamber of the heat exchange device because of the nozzles and cools the target through the first wall of the low-pressure chamber.

In an embodiment of the disclosure, a primary cooling area is defined between each said nozzle and the first wall of the low-pressure chamber, and the other area of the low-pressure chamber is defined as a secondary cooling area, wherein the high-pressure fluid entering the high-pressure chamber is liquid, wherein the low-pressure fluid within the primary cooling area exhibits gas-liquid coexistence, wherein the low-pressure fluid within the secondary cooling area is gaseous.

In an embodiment of the disclosure, the secondary cooling area surrounds the high-pressure chamber, allowing the low-pressure fluid to cool the high-pressure chamber.

Therefore, the expansion process and the evaporation process are designed to take place together inside the heat exchange device to limit the low-temperature region, dispense with a pipeline which must be otherwise provided to link the expansion process and the evaporation process of the fluid and may otherwise cause cooling capability loss, and thus greatly enhance heat exchange capability.

DETAILED DESCRIPTION OF THE EMBODIMENTS

Objectives, features, and advantages of the present disclosure are hereunder illustrated with specific embodiments, depicted with drawings, and described below.

In the disclosure, descriptive terms such as "a" or "one" are used to describe the unit, component, structure, device, module, system, portion, section or region, and are for illustration purposes and providing generic meaning to the scope of the present invention. Therefore, unless otherwise explicitly specified, such description should be understood as including one or at least one, and a singular number also includes a plural number.

In the disclosure, descriptive terms such as "include, comprise, have" or other similar terms are not for merely limiting the essential elements listed in the disclosure, but can include other elements that are not explicitly listed and are however usually inherent in the units, components, structures, devices, modules, systems, portions, sections or regions.

In the disclosure, the terms similar to ordinals such as "first" or "second" described are for distinguishing or referring to associated identical or similar components or structures, and do not necessarily imply the orders of these components, structures, portions, sections or regions in a spatial aspect. It should be understood that, in some situations or configurations, the ordinal terms could be interchangeably used without affecting the implementation of the present invention.

Figure 1:
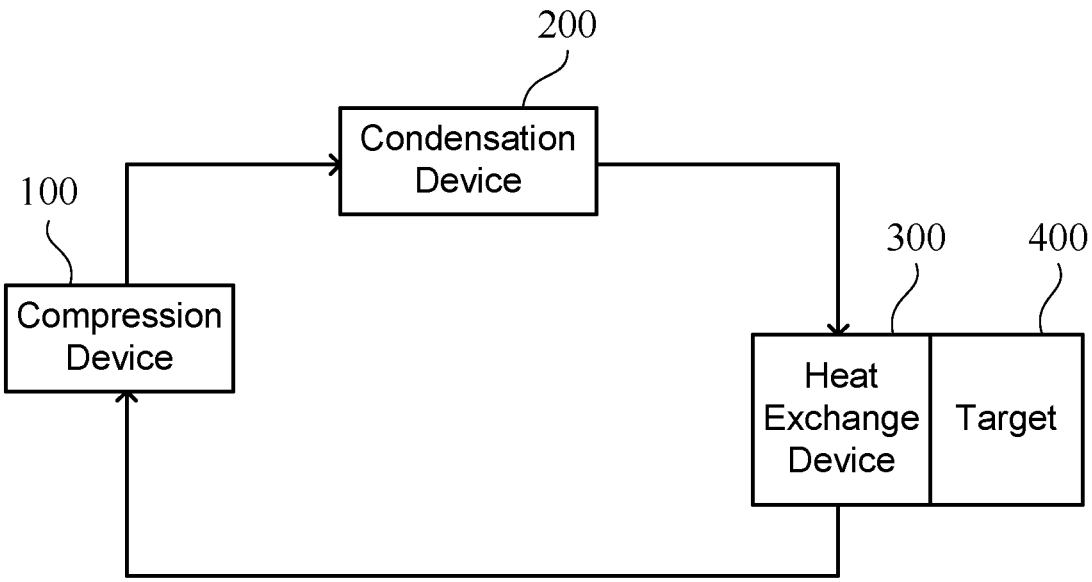
FIG. 1 is a block diagram of a cooling system in an embodiment of the disclosure.

Referring to FIG. 1, there is shown a block diagram of a cooling system in an embodiment of the disclosure. The cooling system comprises a compression device 100, condensation device 200 and heat exchange device 300. A fluid, such as a coolant, is circularly conveyed within the cooling system.

The compression device 100 receives the gaseous fluid produced as a result of evaporation of the fluid in the heat exchange device 300, compresses the gaseous fluid to produce a high-pressure, high-temperature gaseous fluid, and supplies the high-pressure, high-temperature gaseous fluid to the condensation device 200 at a back end. The condensation device 200 dissipates heat from and lowers the temperature of the high-pressure, high-temperature gaseous fluid to cause the high-pressure, high-temperature gaseous fluid to condense into a high-pressure, normal-temperature liquid fluid.

In an embodiment of the disclosure, the heat exchange device 300 integrates an expansion process and an evaporation process of a fluid. The heat exchange device 300 is in direct or indirect contact with a target 400 to cool the target 400 at a low temperature generated by the evaporation process. The heat exchange device 300 receives the high-pressure fluid outputted from the condensation device 200, such that the liquid high-pressure fluid undergoes the expansion process to have its pressure and temperature reduced (for example, to −20 degrees through −35 degrees). Cooling capability (evaporation process) is provided at a point defined on the heat exchange device 300 and adapted to directly or indirectly lower the temperature of the target 400, such that the fluid absorbs heat and thus undergoes a phase change to turn into a low-pressure gaseous fluid before being returned to the compression device 100.

Therefore, the fluid conveyed between the condensation device 200 and the heat exchange device 300 is a high-pressure, normal-temperature liquid fluid. The conveying pipeline between the condensation device 200 and the heat exchange device 300 dispenses with a thermal insulating layer to reduce the construction cost of the cooling system. The cooling capability of the cooling system is directly provided inside the heat exchange device 300 to preclude a loss otherwise caused to the cooling capability on the conveying pipeline; thus, the cooling efficiency of the cooling system toward the target 400 is effectively enhanced. In a subsequent embodiment, the target 400 is, for example, a portion of the inner wall of the heat exchange device 300, and functions as a heat conducting plate for transferring external heat.

Figure 2:
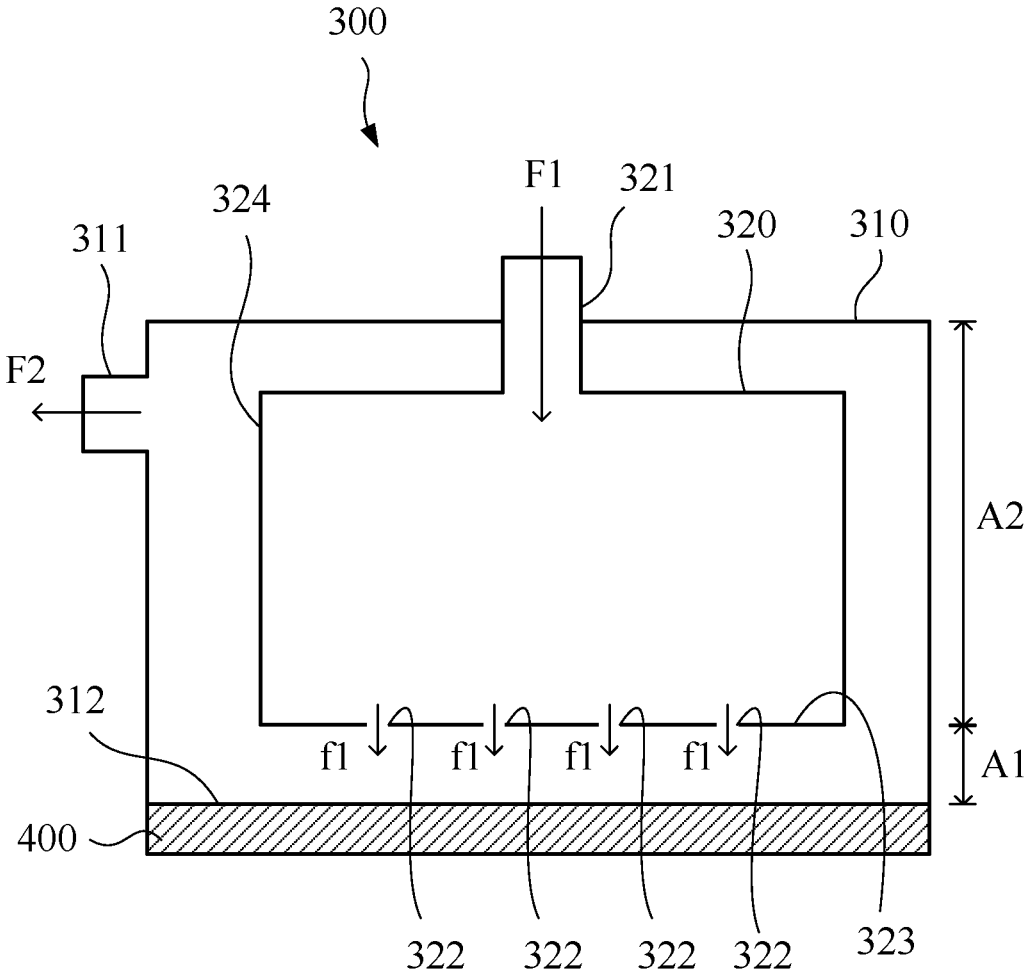
FIG. 2 is a cross-sectional view of a heat exchange device in an embodiment of the disclosure.

Referring to FIG. 2, there is shown a cross-sectional view of a heat exchange device in an embodiment of the disclosure. The heat exchange device 300 comprises a low-pressure chamber 310 and a high-pressure chamber 320. The high-pressure chamber 320 is disposed in the low-pressure chamber 310, such that the high-pressure chamber 320 is enclosed in the low-pressure chamber 310. The high-pressure chamber 320 has an input portion 321. The input portion 321 serves as a passage whereby an external fluid enters the heat exchange device 300, so as to receive a high-pressure fluid F1 (operating under a charging pressure) from the condensation device 200.

A plurality of nozzles 322 are disposed on an inner wall of the high-pressure chamber 320 and adapted to enable communication between the high-pressure chamber 320 and the low-pressure chamber 310. Under the charging pressure, the high-pressure fluid F1 is driven to the nozzles 322 and ejected therefrom. Given appropriate size of the nozzles 322, the fluid passing through the nozzles 322 undergoes an expansion process (also known as an isoenthalpic pressure drop process) characterized by a pressure drop and a temperature drop. The function of the nozzles 322, for example, corresponds to the function of an electric expansion valve (EEV). Therefore, the fluid discharged from the nozzles 322 turns into a gaseous or gas-liquid coexistence ejected fluid f1.

A first wall 312 for heat exchange is defined on an inner wall of the low-pressure chamber 310. The first wall 312 is in direct or indirect contact with the target 400 to be cooled. As shown in FIG. 2, the first wall 312 is in direct contact with the target 400 to be cooled, whereas the target 400 not only transfers and collects the heat from an object to be cooled but also constitutes a bottom board of the low-pressure chamber 310 and functions as a heat conducting plate. The heat transferred and collected by the target 400 undergoes heat exchange with the ejected fluid f1 through the first wall 312 to achieve cooling. After undergoing heat exchange through the first wall 312, the ejected fluid f1 is turned into a low-pressure fluid F2 operating under a discharging pressure and discharged from an output portion 311 in communication with the outside, so as to return to the compression device 100.

As shown in FIG. 2, the inner wall of the high-pressure chamber 320, on which the nozzles 322 are disposed, is defined as a second wall 323. The second wall 323 is located on one side of the high-pressure chamber 320. Preferably, the second wall 323 faces the first wall 312. The ejected fluid f1 is ejected toward the first wall 312 to form a jet of fluid with an enhanced cooling effect. In a preferred embodiment of the expansion process, a cross-sectional area of each said nozzles 322 is less than the surface area of the second wall 323, for example, less than a predetermined value (to generate effective resistance to the fluid).

The size of the nozzles 322 can be calculated in accordance with an existing relation. For example, given the operating capability of a compressor for use in the cooling system and the types of the fluids for use in the cooling system, the relation defining that the impedance of an expansion valve is directly proportional to $L*D^{4.6}$ (where L denotes opening diameter, and D denotes nozzle length, i.e., wall thickness), the dimensions of the nozzles 322, an R404A coolant functioning as the fluid, a 1HP compressor, and an inner wall thickness of 0.1 inch, it is feasible to attain a pressure drop and a temperature drop corresponding to an EEV with eight nozzles 322 each of an opening diameter of less than 0.006 inch. Given a table of standards of selection of expansion valve capillaries typical of compressors, by matching the selection standards with the directionally proportional relation of the impedance between the expansion valves, it is feasible to calculate appropriate dimensions of the nozzles 322. The nozzles 322 are, for example, provided in the form of holes or slits. Regardless of whether the nozzles 322 are holes or slits, the nozzles 322 always have a relation of pressure difference and flow rate in their channel flow field for use in estimation and calculation; thus, for the sake of brevity, the application of conventional equations is not described herein.

As shown in FIG. 2, with the nozzles 322 facing the first wall 312 (including the situation where a jet of fluid hits the first wall 312 squarely or obliquely), a primary cooling area A1 is defined between the first wall 312 and the nozzles 322. The primary cooling area A1 is intended to cool the target 400 by allowing its transferred and collected heat to undergo heat exchange. Within the low-pressure chamber 310, the area other than the primary cooling area A1 is defined as a secondary cooling area A2, for example, the secondary cooling area A2 surrounding the high-pressure chamber 320. The next-lowest-temperature fluid, which is formed as a result of heat exchange between the fluid of the primary cooling area A1 and the heat from the target 400, flows within the secondary cooling area A2. The primary cooling area A1 is of a lower temperature than the secondary cooling area A2. The cooling capacity is more concentrated on the first wall 312 to cool the external target 400.

Furthermore, the high-pressure chamber 320 is enclosed in the low-pressure chamber 310, and the temperature of the high-pressure fluid F1 in the high-pressure chamber 320 is likely to be higher than the temperature of the secondary cooling area A2; thus, the temperature of the secondary cooling area A2 facilitates the heat exchange (cooling) occurring to the high-pressure fluid F1 in the high-pressure chamber 320 through a cooling wall 324 of the high-pressure chamber 320, thereby making good use of the cooling capability of the cooling system. The high-pressure fluid F1 which is further cooled down enables the expansion process to cause a temperature drop to the ejected fluid f1 more efficiently, thereby enhancing the efficiency of the cooling system.

The cooling wall 324 is defined as an inner wall free of the nozzles 322. The fluid in the primary cooling area A1 is gaseous or preferably exhibits gas-liquid coexistence. The fluid in the secondary cooling area A2 is gaseous.

Figure 3:
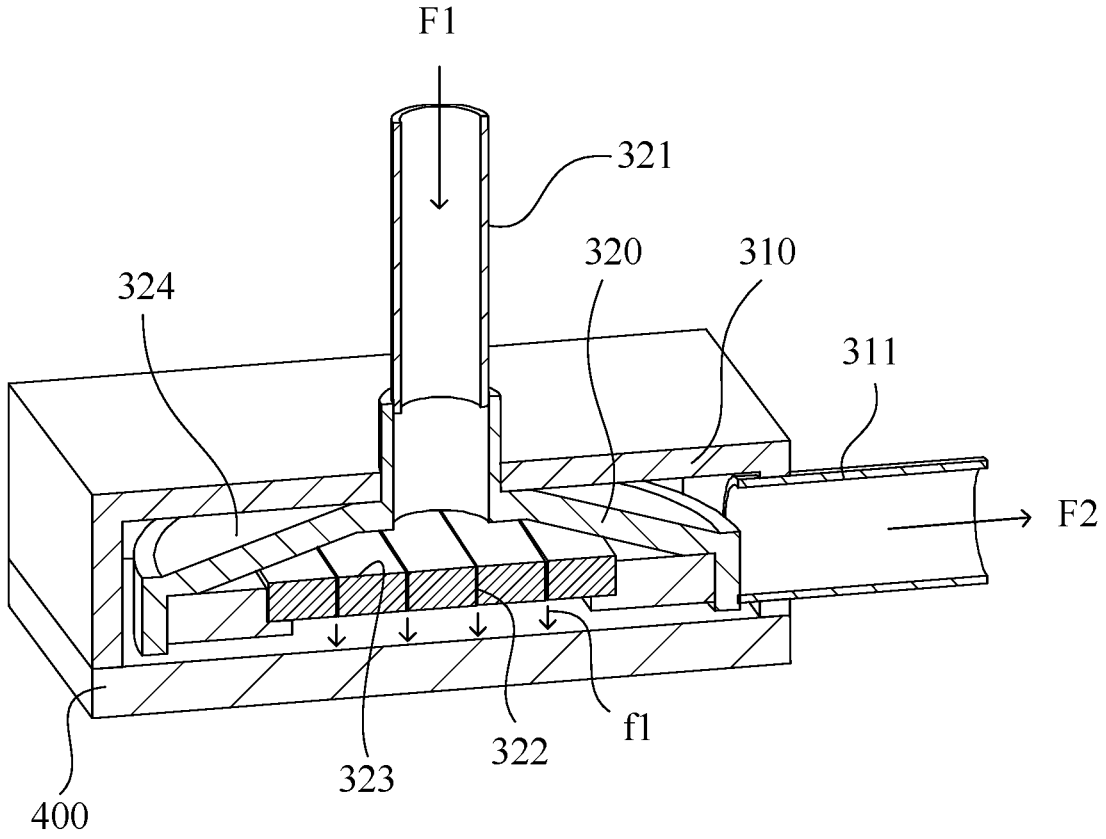
FIG. 3 is a cutaway diagram of the heat exchange device in the first embodiment of the disclosure.
Figure 4:
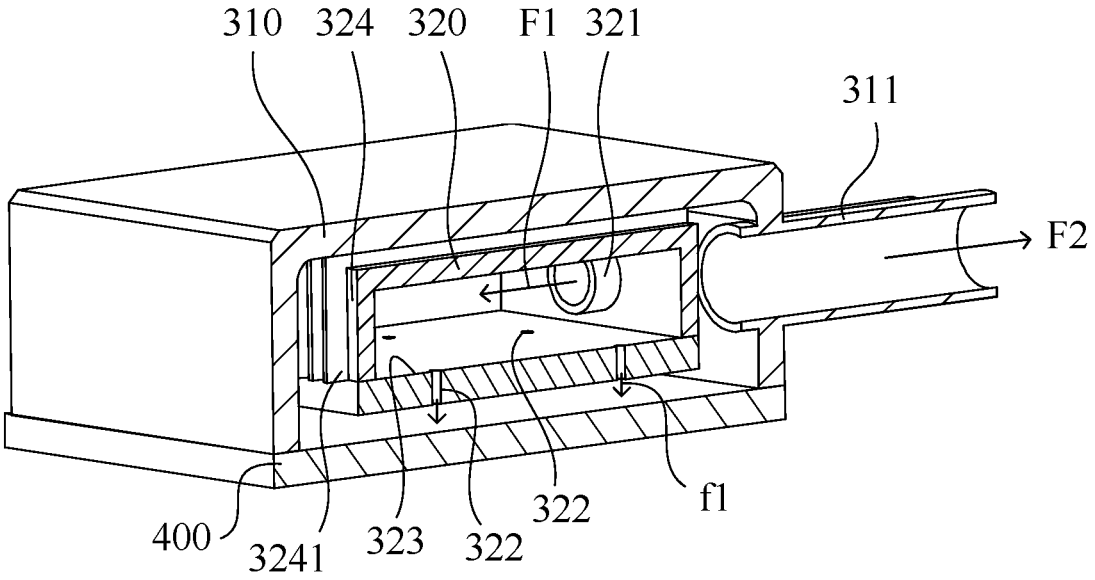
FIG. 4 is a cutaway diagram of the heat exchange device in the second embodiment of the disclosure.

Refer to FIG. 3 and FIG. 4. FIG. 3 is a cutaway diagram of the heat exchange device in the first embodiment of the disclosure. FIG. 4 is a cutaway diagram of the heat exchange device in the second embodiment of the disclosure.

As shown in FIG. 3, the inner wall of the high-pressure chamber 320 takes on a funnel shape, with the second wall 323 defining a bottom of the funnel, and the input portion 321 defining a top of the funnel. The surface of the cooling wall 324 of the funnel-shaped high-pressure chamber 320 is oblique and thus facilitates the flow of the fluid. As shown in FIG. 3, the nozzles 322 of the high-pressure chamber 320 are slits.

In any embodiment of the disclosure, a plurality of heat exchange portions 3241 are disposed on the cooling wall 324 and protrude toward the inside of the low-pressure chamber 310, as shown in FIG. 4. Referring to FIG. 4, the inner wall of the high-pressure chamber 320 takes on a rectangle shape, with the second wall 323 defining a bottom of the rectangle, and the input portion 321 defining a lateral side of the rectangle. As shown in FIG. 4, the nozzles 322 of the high-pressure chamber 320 are holes.

As shown in FIG. 3 and FIG. 4, the input portion 321 and the output portion 311 are located at different positions, respectively, and operate in conjunction with different heat exchange devices, depending on the environmental requirements of the cooling system.

In conclusion, with the high-pressure chamber 320 being enclosed in the low-pressure chamber 310, and the cooling capability being developed in the heat exchange device 300 and working in the heat exchange device 300, it is feasible to dispense with a pipeline which must be otherwise provided to link the expansion process and the evaporation process of the fluid and may otherwise cause cooling capability loss, so as to greatly enhance heat exchange capability and cooling efficiency.

The present disclosure is illustrated by various aspects and embodiments. However, persons skilled in the art understand that the various aspects and embodiments are illustrative rather than restrictive of the scope of the present disclosure. After perusing this specification, persons skilled in the art may come up with other aspects and embodiments without departing from the scope of the present disclosure. All equivalent variations and replacements of the aspects and the embodiments must fall within the scope of the present disclosure. Therefore, the scope of the protection of rights of the present disclosure shall be defined by the appended claims.

What is claimed is:

1. A heat exchange device for receiving a high-pressure fluid and outputting a low-pressure fluid, the heat exchange device comprising:

a low-pressure chamber having a first wall for enabling heat exchange and having an output portion in communication with an outside of the heat exchange device to output the low-pressure fluid; and a high-pressure chamber disposed in and enclosed by the low-pressure chamber, having an input portion in communication with the outside of the heat exchange device to admit the high-pressure fluid, and having a plurality of nozzles in communication with the low-pressure chamber and having at least one cooling wall free of said nozzles, wherein a primary cooling area is defined between each said nozzle and the first wall of the low-pressure chamber, and a secondary cooling area is defined near the at least one cooling wall, with a temperature of the primary cooling area being lower than a temperature of the secondary cooling area, wherein a fluid discharged from the nozzles undergoes a pressure drop, enters the low-pressure chamber, and undergoes heat exchange through the first wall so as to be turned into the low-pressure fluid, wherein the low-pressure fluid undergoes heat exchange with the high-pressure fluid in the high-pressure chamber via the at least one cooling wall in the secondary cooling area and is then discharged from the output portion of the low-pressure chamber.

2. The heat exchange device of claim 1, wherein the nozzles enable the high-pressure fluid to undergo a pressure drop and a temperature drop.

3. The heat exchange device of claim 1, wherein the nozzles are disposed on a second wall of the high-pressure chamber, and a cross-sectional area of each said nozzle is less than a predetermined value to cause the high-pressure fluid being discharged from the nozzles to turn into a jet of low-temperature fluid.

4. The heat exchange device of claim 3, wherein the second wall faces the first wall.

5. The heat exchange device of claim 3, wherein an inner wall of the high-pressure chamber takes on a funnel shape, with the second wall defining a bottom of the funnel, and the input portion defining a top of the funnel.

6. The heat exchange device of claim 1, wherein the nozzles are each a hole.

7. The heat exchange device of claim 1, wherein the nozzles are each a slit.

8. The heat exchange device of claim 1, wherein the nozzles enable the high-pressure fluid to turn into a jet of fluid hitting the first wall.

9. The heat exchange device of claim 1, wherein a plurality of heat exchange portions are disposed on the at least one cooling wall and protruding toward the low-pressure chamber.

10. The heat exchange device of claim 9, wherein the heat exchange portions are each a fin.

11. The heat exchange device of claim 1, wherein the other area of the low-pressure chamber outside the primary cooling area is the secondary cooling area, wherein the high-pressure fluid entering the high-pressure chamber is liquid, wherein the low-pressure fluid within the primary cooling area exhibits gas-liquid coexistence, wherein the low-pressure fluid within the secondary cooling area is gaseous.

12. The heat exchange device of claim 11, wherein the secondary cooling area surrounds the high-pressure chamber.

13. A cooling system, adapted to cool a target, comprising:

a compression device;

a condensation device for receiving a fluid of a high pressure and a high temperature from the compression device, causing the temperature of the fluid to drop, and outputting a high-pressure fluid of a high pressure and a normal temperature; and the heat exchange device of claim 1 for receiving the high-pressure fluid outputted from the condensation device and outputting the low-pressure fluid to the compression device, wherein the high-pressure fluid undergoes a pressure drop and a temperature drop in the high-pressure chamber of the heat exchange device because of the nozzles and cools the target through the first wall of the low-pressure chamber.

* * * * *